US008564380B2

(12) United States Patent
Kishimoto et al.

(10) Patent No.: US 8,564,380 B2
(45) Date of Patent: Oct. 22, 2013

(54) NON-RECIPROCAL CIRCUIT DEVICE AND ITS CENTRAL CONDUCTOR ASSEMBLY

(75) Inventors: Yasushi Kishimoto, Tottori (JP); Hiroshi Matsuno, Tottori (JP); Kenji Kuramoto, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 12/524,825

(22) PCT Filed: Jan. 29, 2008

(86) PCT No.: PCT/JP2008/051320

§ 371 (c)(1),
(2), (4) Date: Jul. 28, 2009

(87) PCT Pub. No.: WO2008/093681

PCT Pub. Date: Aug. 7, 2008

(65) Prior Publication Data

US 2010/0060374 A1 Mar. 11, 2010

(30) Foreign Application Priority Data

Jan. 30, 2007 (JP) ..... 2007-019614

(51) Int. Cl.
*H01P 1/36* (2006.01)

(52) U.S. Cl.
USPC ..... 333/1.1; 333/24.2

(58) Field of Classification Search
USPC ..... 333/1.1, 24.2
See application file for complete search history.

(56) References Cited

U.S. PATENT DOCUMENTS

| | | | | |
|---|---|---|---|---|
| 5,450,045 | A * | 9/1995 | Miura et al. | 333/1.1 |
| 5,774,024 | A | 6/1998 | Marusawa et al. | |
| 6,914,496 | B2 | 7/2005 | Tanaka | |
| 2003/0112579 | A1 | 6/2003 | Matsuta et al. | |
| 2004/0263278 | A1 | 12/2004 | Hino | |
| 2005/0052256 | A1 * | 3/2005 | Hasegawa et al. | 333/24.2 |

FOREIGN PATENT DOCUMENTS

| | | | |
|---|---|---|---|
| EP | 0618636 | A2 * | 10/1994 |
| EP | 1 615 269 | A1 | 1/2006 |
| JP | 62-258503 | A | 11/1987 |
| JP | 07-212107 | A | 8/1995 |
| JP | 2000-049508 | A | 2/2000 |
| JP | 2004-015430 | A | 1/2004 |
| JP | 2005-020195 | A | 1/2005 |

OTHER PUBLICATIONS

European Search Report dated Feb. 14, 2011.

* cited by examiner

*Primary Examiner* — Stephen Jones
(74) *Attorney, Agent, or Firm* — Sughrue Mion, PLLC

(57) ABSTRACT

A central conductor assembly for a non-reciprocal circuit device, at least a first central conductor constituting a first inductance element and a second central conductor constituting a second inductance element being integrally formed in a laminate comprising pluralities of magnetic layers, the first central conductor being formed by series-connecting first and second lines formed on a first main surface of the laminate to third lines formed in the laminate through via-holes, and the second central conductor being formed on the first main surface of the laminate such that it extends between the first and second lines and crosses the third lines via a magnetic layer.

6 Claims, 8 Drawing Sheets

NON-RECIPROCAL CIRCUIT DEVICE AND ITS CENTRAL CONDUCTOR ASSEMBLY

CROSS REFERENCE TO RELATED APPLICATIONS

This application is a National Stage of International Application No. PCT/JP2008/051320 filed Jan. 29, 2008, claiming priority based on Japanese Patent Application No. 2007-019614, filed Jan. 30, 2007, the contents of all of which are incorporated herein by reference in their entirety.

FIELD OF THE INVENTION

The present invention relates to a non-reciprocal circuit device called isolator used in microwave communications apparatuses such as cell phones, etc., and its central conductor assembly.

BACKGROUND OF THE INVENTION

A non-reciprocal circuit device is a circuit device comprising a magnetic body of ferrite such as garnet, pluralities of crossing central conductors disposed on the magnetic body, and a magnet applying a DC magnetic field to the magnetic body to generate a rotating resonance magnetic field in the magnetic body, thereby transmitting signals input to one central conductor to another central conductor without attenuation.

FIG. 12 shows the equivalent circuit of a non-reciprocal circuit device called "two-port isolator," which is disclosed in JP 2004-15430 A, and FIG. 13 shows the structure of this non-reciprocal circuit device. This two-port isolator comprises a first input/output port P1, a second input/output port P2, a first inductance element Lin and a first matching capacitor Ci connected between the input/output ports P1, P2 for constituting a first parallel resonance circuit, a resistance element R parallel-connected to the first parallel resonance circuit, and a second inductance element Lout and a second matching capacitor Cf connected between the second input/output port P2 and the ground for constituting a second parallel resonance circuit. The feature of the two-port isolator is that the first parallel resonance circuit determines a frequency at which isolation (opposite-direction attenuation) is maximum, while the second parallel resonance circuit determines a frequency at which insertion loss is minimum.

As shown in FIG. 13, the first inductance element Lin and the second inductance element Lout are in a strip shape constituted by the first central conductor Lin and the second central conductor Lout, crossing with insulation on or in a ferrite plate, to which a DC magnetic field is applied from a permanent magnet 30, to constitute a central conductor assembly 4. The first matching capacitor Ci and the second matching capacitor Cf are formed by electrode patterns in the multilayer ceramic substrate 10. A main surface of the multilayer ceramic substrate 10 is provided with an electrode pad 15 and connecting pads 17, 18. The electrode pad 15 is connected to a terminal electrode P2 of the second central conductor Lout formed on a side surface of the multilayer ceramic substrate 10 through via-holes electrode and side-surface electrodes. The connecting pad 17 is connected to a terminal electrode P1 of the first central conductor Lin formed on a side surface of the multilayer ceramic substrate 10 through via-holes electrode and side-surface electrodes. The connecting pad 18 is connected to a ground electrode GND through via-holes electrode and side-surface electrodes. The permanent magnet 30, the central conductor assembly 4 and the multilayer ceramic substrate 10 are contained in upper and lower cases 22, 25 made of a magnetic metal.

As the miniaturization, size reduction and multi-functionalization of cell phones lead to increase in the number of parts, strong demand is mounting on the size reduction of isolators used in cell phones. At present, isolators having outer sizes of 3.2 mm×3.2 mm×1.2 mm and 3.2 mm×2.5 mm×1.2 mm are widely used, but smaller isolators are required. To achieve such size reduction, multilayer ceramic substrates, central conductor assemblies, etc. constituting two-port isolators should be reduced in size.

There are various conventional central conductor assemblies integrally comprising central conductors and ferrite bodies; for instance, those having copper foils wound around a ferrite plate, those having an integrally sintered laminate structure comprising pluralities of ferrite sheets printed with a silver paste to form central conductor patterns (FIG. 14) disclosed in JP 7-212107 A, etc. However, the size reduction of central conductor assemblies to about 1.5 mm×1.5 mm in outer size makes copper foils as thin as about 0.15 mm, vulnerable to breakage, making it difficult to wind central conductors around a ferrite plate at a predetermined crossing angle with secure insulation and high accuracy. On the other hand, the laminated central conductor assembly, which has an integral monolithic structure comprising ferrite and central conductors, is free from the problems of copper foils, but it cannot easily have a large quality coefficient Q, and suffers large resistance, resulting in poor electric characteristics such as insertion loss, etc.

OBJECT OF THE INVENTION

Accordingly, an object of the present invention is to provide a central conductor assembly having an integral, monolithic laminate structure comprising a magnetic body and central conductors, and a non-reciprocal circuit device comprising such central conductor assembly to have excellent insertion loss characteristics.

DISCLOSURE OF THE INVENTION

The central conductor assembly of the present invention for use in a non-reciprocal circuit device comprising a first inductance element and a first capacitance element constituting a first parallel resonance circuit between a first input/output port and a second input/output port, and a second inductance element and a second capacitance element constituting a second parallel resonance circuit between the second input/output port and the ground, comprises the first and second inductance elements, at least a first central conductor constituting the first inductance element, and a second central conductor constituting the second inductance element being integrally formed in a laminate comprising pluralities of magnetic layers;

the first central conductor being formed by series-connecting first and second lines formed on a first main surface of the laminate to third lines formed in the laminate through via-holes; and the second central conductor being formed on the first main surface of the laminate, such that it extends between the first and second lines and crosses the third lines via a magnetic layer.

The first inductance element preferably is formed by connecting pluralities of the first central conductors in parallel.

This structure lowers the resistance of the first inductance element, and makes the adjustment of inductance easy.

It is preferable that pluralities of the first to third lines are arranged in parallel, and that the second central conductor is perpendicular to the third lines via a magnetic layer. First terminal electrodes connected to the first central conductor and second terminal electrodes connected to the second central conductor preferably are formed on a second main surface of the laminate. The parallel connection of pluralities of the first lines and the parallel connection of pluralities of the second lines preferably are achieved through electrodes formed in the laminate.

The non-reciprocal circuit device of the present invention comprises a first inductance element and a first capacitance element constituting a first parallel resonance circuit between a first input/output port and a second input/output port, and a second inductance element and a second capacitance element constituting a second parallel resonance circuit between the second input/output port and the ground, a central conductor assembly comprising the first and second inductance elements, at least a first central conductor constituting the first inductance element and a second central conductor constituting the second inductance element being integrally formed in a laminate comprising pluralities of magnetic layers, the first central conductor being formed by series-connecting first and second lines formed on a first main surface of the laminate to third lines formed in the laminate through via-holes, and the second central conductor being formed on the first main surface of the laminate such that it extends between the first and second lines and crosses the third lines via a magnetic layer;

a permanent magnet for applying a DC magnetic field to the central conductor assembly; and a multilayer substrate containing the first and second capacitance elements;

the central conductor assembly being mounted on a main surface of the multilayer substrate.

BRIEF DESCRIPTION OF THE DRAWINGS

FIG. 11(*b*) is a graph showing the isolation characteristics of the non-reciprocal circuit devices of Example 1 and Comparative Examples 1 and 2.

DESCRIPTION OF THE PREFERRED EMBODIMENTS

Figure 1:
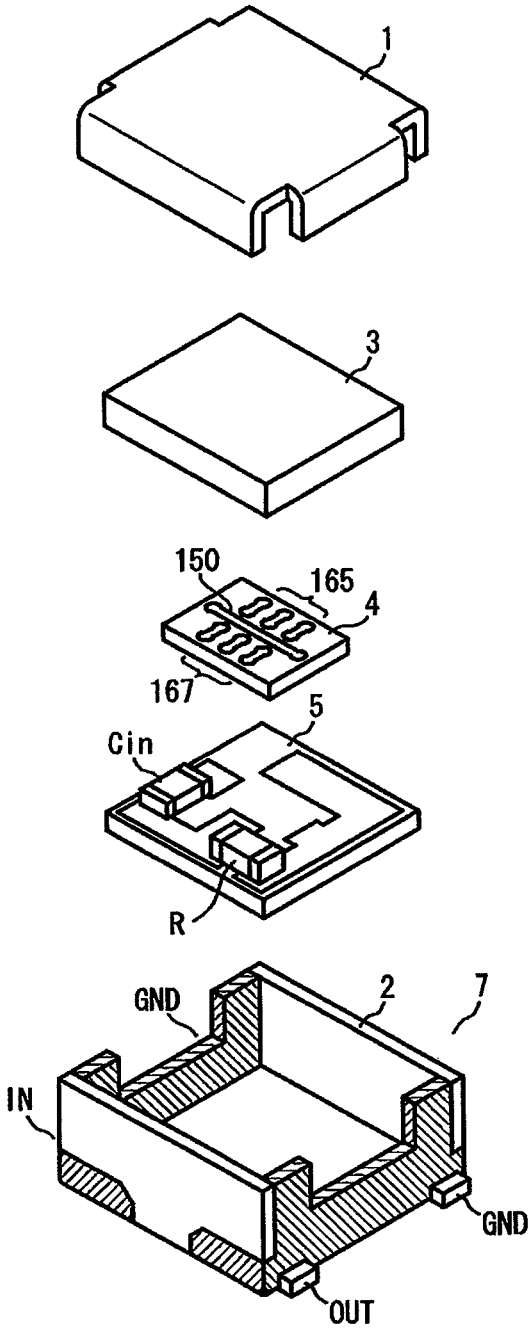
FIG. 1 is an exploded perspective view showing a non-reciprocal circuit device according to one embodiment of the present invention.
Figure 2:
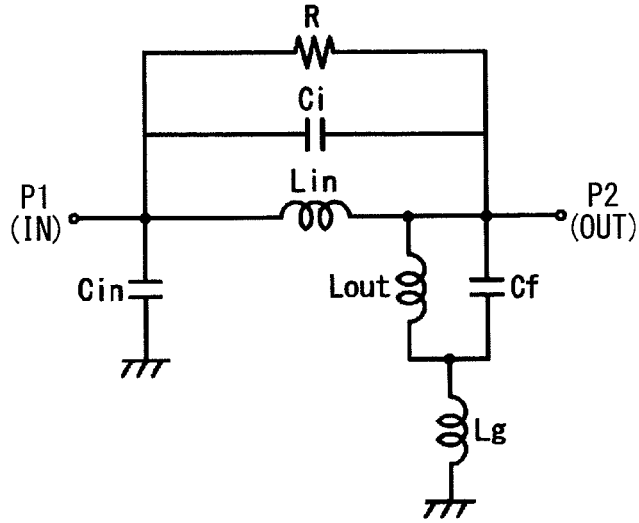
FIG. 2 is a view showing an equivalent circuit of the non-reciprocal circuit device according to one embodiment of the present invention.

FIG. 1 shows the structure of a non-reciprocal circuit device according to one embodiment of the present invention. The non-reciprocal circuit device comprises a central conductor assembly 4, a multilayer ceramic substrate (capacitor laminate) 5 for mounting the central conductor assembly 4, a resistor R and a capacitance element Cin mounted on the multilayer ceramic substrate 5, a permanent magnet 3 for applying a DC magnetic field to the central conductor assembly 4, and upper and lower metal cases 1, 2 acting as a magnetic yoke. FIG. 2 shows the equivalent circuit of the non-reciprocal circuit device. The circuit of this non-reciprocal circuit device is the same as that of the above-described two-port isolator, except that the former comprises a capacitance element Cin as an impedance-matching circuit and an inductance element Lg for expanding a signal-passing band.

Figure 3:
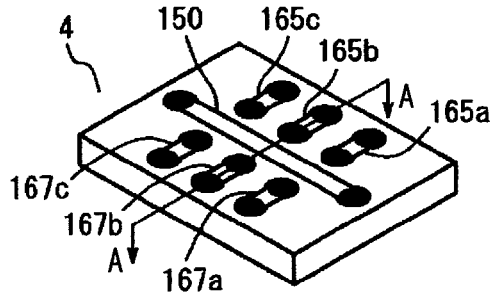
FIG. 3 is a perspective view showing a central conductor assembly according to one embodiment of the present invention.
Figure 4:
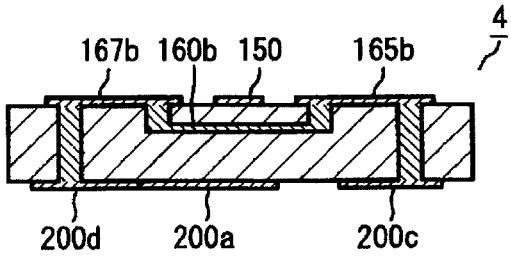
FIG. 4 is a cross-sectional view taken along the line A-A in FIG. 3.
Figure 5:
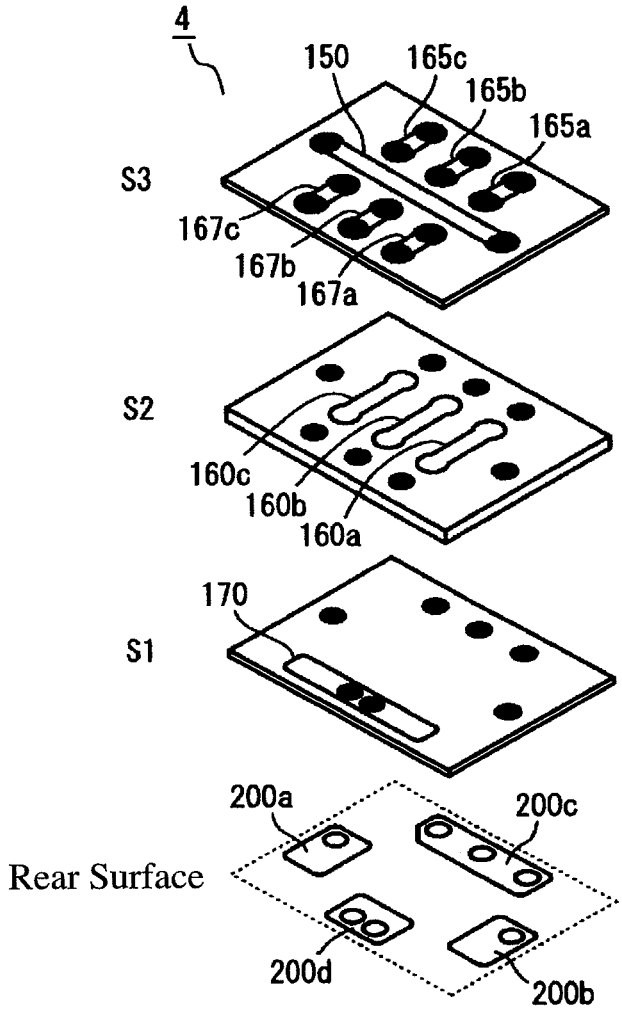
FIG. 5 is an exploded perspective view showing a central conductor assembly according to one embodiment of the present invention.

FIG. 3 shows the appearance of the central conductor assembly 4, FIG. 4 shows the A-A cross section of the central conductor assembly 4, and FIG. 5 shows the internal structure of the central conductor assembly 4. The central conductor assembly 4 comprises first lines 165*a*-165*c*, second lines 167*a*-167*c* and third lines 160*a*-160*c* for forming a first central conductor constituting a first inductance element Lin, and a second central conductor 150 constituting a second inductance element Lout. As shown in FIG. 5, on a layer S3, the first lines 165*a*-165*c* and the second lines 167*a*-167*c* are arranged symmetrically on both sides of the second central conductor 150. The third lines 160*a*-160*c* formed on a layer S2 are connected to ends of the first lines 165*a*-165*c* and ends of the second lines 167*a*-167*c* through via-holes formed in a layer S3. As a result, the third lines 160*a*-160*c* cross the second central conductor 150 via a magnetic layer. In this example, the first to third lines 165*a*-165*c*, 167*a*-167*c* and 160*a*-160*c* are parallel and perpendicular to the second central conductor 150, though not restrictive of course.

A common connecting electrode 170 is formed on the layer S1. The other ends of the first lines 165*a*-165*c* are connected to a common terminal electrode 200*c* through via-holes (indicated by black circles in the figures) formed in the layers S1-S3, and the other ends of the second lines 167*a*-167*c* are connected to a common connecting electrode 170 on the layer S1 through via-holes formed in the layer S2, S3, and further connected to a terminal electrode 200*d* through via-holes provided in the common connecting electrode 170. Both ends of the second central conductor 150 are connected to terminal electrodes 200*a*, 200*b* through via-holes formed in the layers S1-S3.

To constitute the central conductor assembly 4, green sheets are first formed from powder of magnetic ceramics such as garnet ferrite, etc. by a doctor blade method. The composition of the magnetic ceramic powder is, for instance, $(Y_{1.45}Bi_{0.85}Ca_{0.7})(Fe_{3.95}In_{0.3}Al_{0.4}V_{0.35})O_{12}$ (atomic ratio). To produce green sheets having this composition, for instance, starting materials of $Y_2O_3$, $Bi_2O_3$, $CaCO_3$, $Fe_2O_3$, $In_2O_3$, $Al_2O_3$ and $V_2O_5$ are wet-mixed by a ball mill to form slurry, which is dried, calcined at 850° C., and then wet-pulverized by a ball mill. The resultant polycrystalline magnetic ceramic powder is mixed with an organic binder (for instance, polyvinyl butyral), a plasticizer (for instance, butyl phthalyl butyl glycolate), and an organic solvent (for instance, ethanol or butanol) by a ball mill, adjusted in viscosity, and then formed into sheets by a doctor blade method. Each green sheet is as thick as 40 μm and 80 μm, for instance, after sintering. The green sheets are printed with a conductive paste of Ag, Cu, etc. in predetermined patterns to form electrode patterns including the first and second central conductors, and their through-holes are filled with the conductive paste to form via-holes. The green sheets provided with electrode patterns are laminated, heat-pressed, provided with slits at predetermined intervals by a dicing saw or a steel blade, and then sintered to produce a substrate assembly comprising pluralities of central conductor assemblies. The substrate assembly is divided through the slits to provide separate central conductor assemblies, and the surface-exposed via-holes and lines, and terminal electrodes are plated. The division of the substrate assembly may be conducted before sintering, and the slits may be provided after sintering, and further plating may be omitted.

The central conductor assembly thus obtained has an external size of 1.6 mm×1.3 mm×0.2 mm; for instance, each line having a width of 0.1 mm and a thickness of 20 μm, first to third lines having an intercenter distance (pitch) of 0.3 mm, and an interval being 40 μm between the third lines 160 and the second central conductor 150. Each via-hole has a circular cross section of 0.12 mm in diameter, though it may have a different cross section shape.

Figure 6:
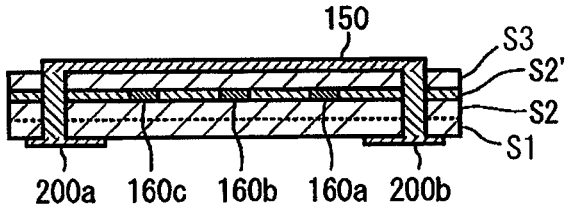
FIG. 6 is a cross-sectional view showing a central conductor assembly according to another embodiment of the present invention.

When the third lines 160*a*-160*c* are made thicker to reduce resistance, an interval increases between the green sheets S2 and S3, so that lateral displacement of lamination and delamination after pressure-bonding may occur. To prevent such problems, a region of the green sheet S2 except the third lines 160*a*-160*c* need only be printed with a magnetic ceramic powder paste having the same thickness as those of the third lines 160*a*-160*c* (layer S2' shown in FIG. 6). The magnetic ceramic powder paste may be prepared by mixing the same magnetic ceramic powder as that of the green sheets with a binder such as ethyl cellulose and a solvent. When a paste of borosilicate glass or a low-temperature-sinterable dielectric material is used in place of the magnetic ceramic powder paste, the layer S2' acts as a magnetic gap, improving the quality coefficient Q of inductance elements.

Figure 7:
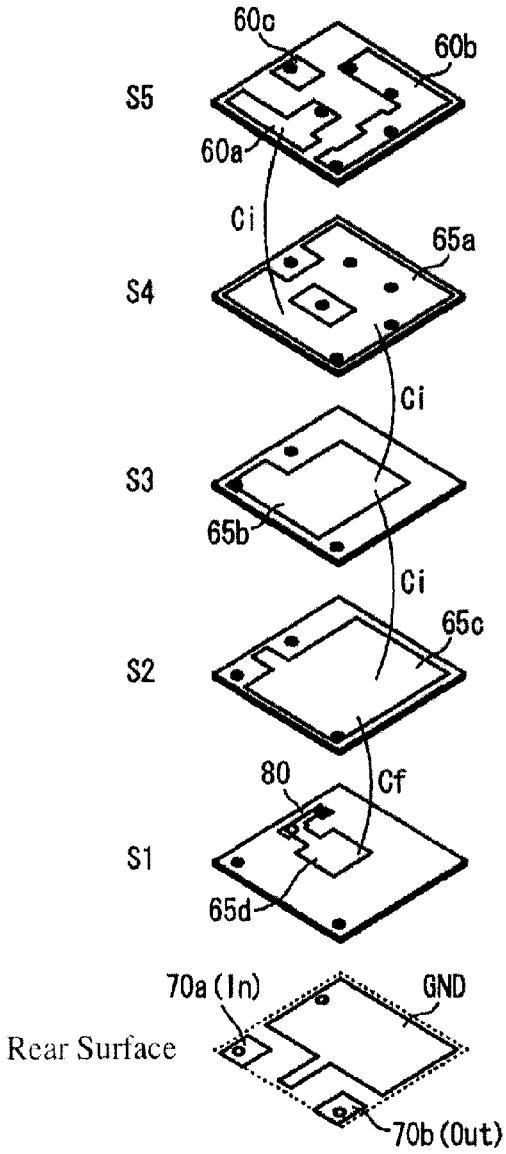
FIG. 7 is an exploded perspective view showing a multilayer substrate (capacitor laminate) used in the non-reciprocal circuit device according to one embodiment of the present invention.

FIG. 7 shows the layer structure of the multilayer ceramic substrate 5. The multilayer ceramic substrate 5 is also an integrally sintered laminate containing capacitance electrodes 65*a*-65*d* for capacitance elements Ci, Cf, and a line electrode 80 for an inductance element Lg. The laminate has a upper surface provided with electrodes 60*a*-60*c* connected to the terminal electrodes 200*a*-200*d* of the central conductor assembly 4, and a rear surface provided with input and output terminals 70*a* (In), 70*b* (Out) and a ground terminal GND connected to terminals IN, OUT, GND formed on a resin case 7 integrally comprising a metal-made lower case 2. In this example, the capacitance element Cin is mounted on the multilayer ceramic substrate 5, but it may be formed by capacitance electrodes in the multilayer ceramic substrate 5.

EXAMPLE 1

The multilayer ceramic substrate 5 shown in FIG. 7 and the central conductor assembly 4 shown in FIG. 5 were arranged in this order in the resin case 7, and electrically connected, and a permanent magnet 3 and a metal-made upper case 1 were arranged as shown in FIG. 1 to constitute a non-reciprocal circuit device of, for instance, 2.8 mm×2.5 mm×1.1 mm.

COMPARATIVE EXAMPLES 1 and 2

Figure 8:
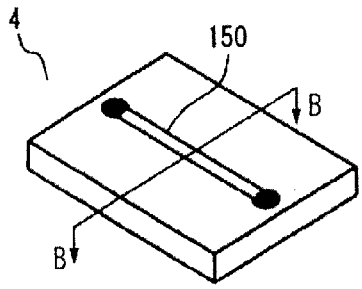
Fig. 8 Related Art
FIG. 8 is a perspective view showing a conventional central conductor assembly.
Figure 9:
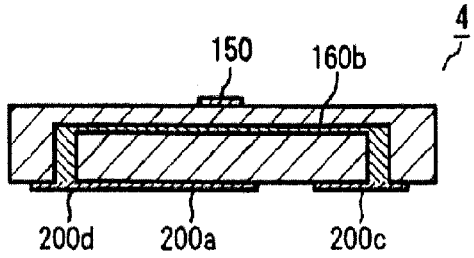
Fig. 9 Related Art
FIG. 9 is a cross-sectional view taken along the line in FIG. 8.
Figure 10:
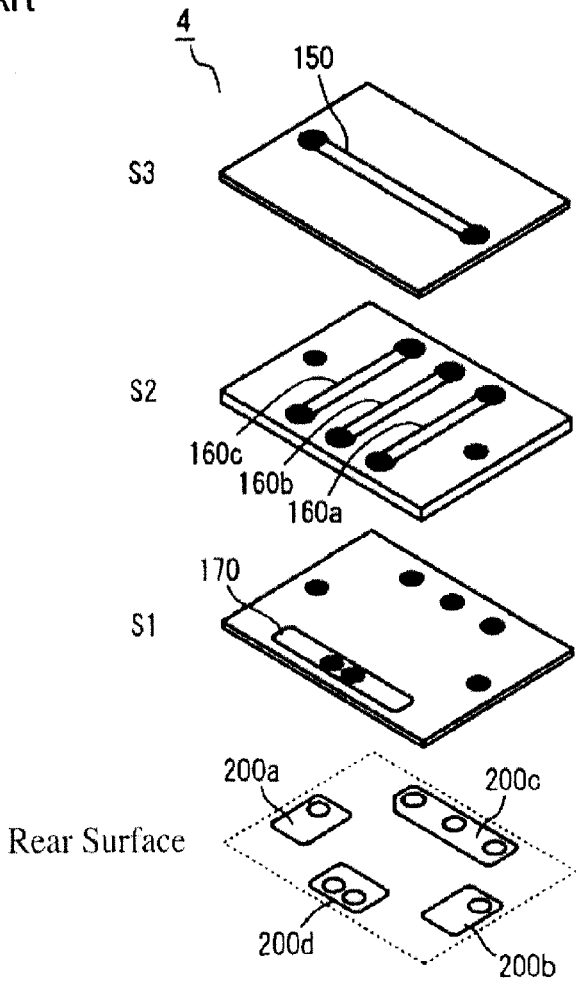
Fig. 10 Related Art
FIG. 10 is an exploded perspective view showing a conventional central conductor assembly.

FIGS. 8-10 show the central conductor assembly of Comparative Example 1. This central conductor assembly differs from the central conductor assembly of the present invention in that first central conductor lines 160*a*-160*c* are disposed in the laminate. The central conductor assembly of Comparative Example 2 has first central conductor lines 160*a*-160*c* on the laminate surface, and a second central conductor 150 inside the laminate, contrary to the central conductor assembly of Comparative Example 1. Using the central conductor assemblies of Comparative Examples 1 and 2, non-reciprocal circuit devices were produced in the same manner as above.

Figure 11A:
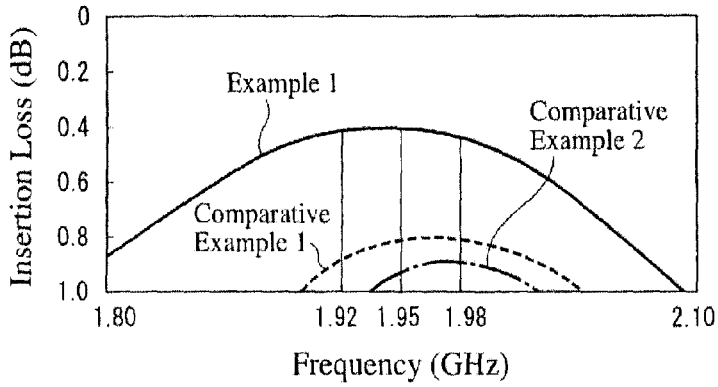
FIG. 11(*a*) is a graph showing the insertion loss characteristics of the non-reciprocal circuit devices of Example 1 and Comparative Examples 1 and 2.
Figure 11B:
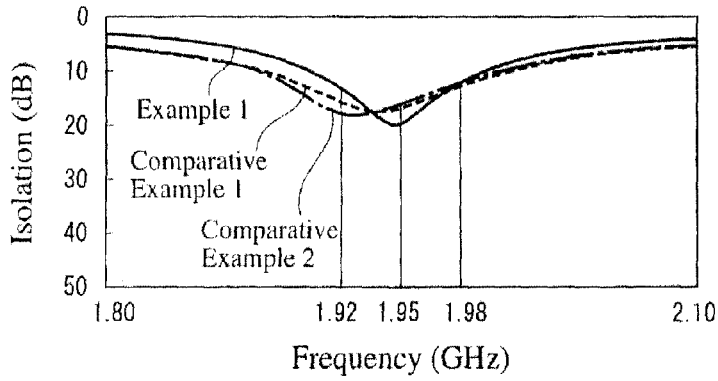
Figure 12:
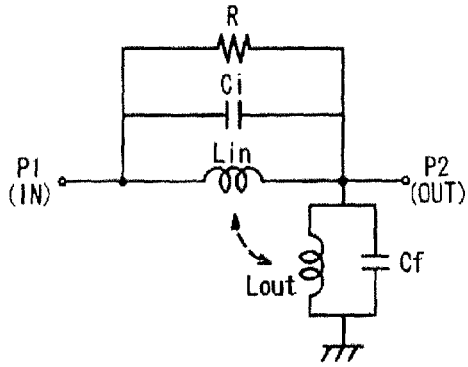
Fig. 12 Related Art
FIG. 12 is a view showing the equivalent circuit of a conventional non-reciprocal circuit device.
Figure 13:
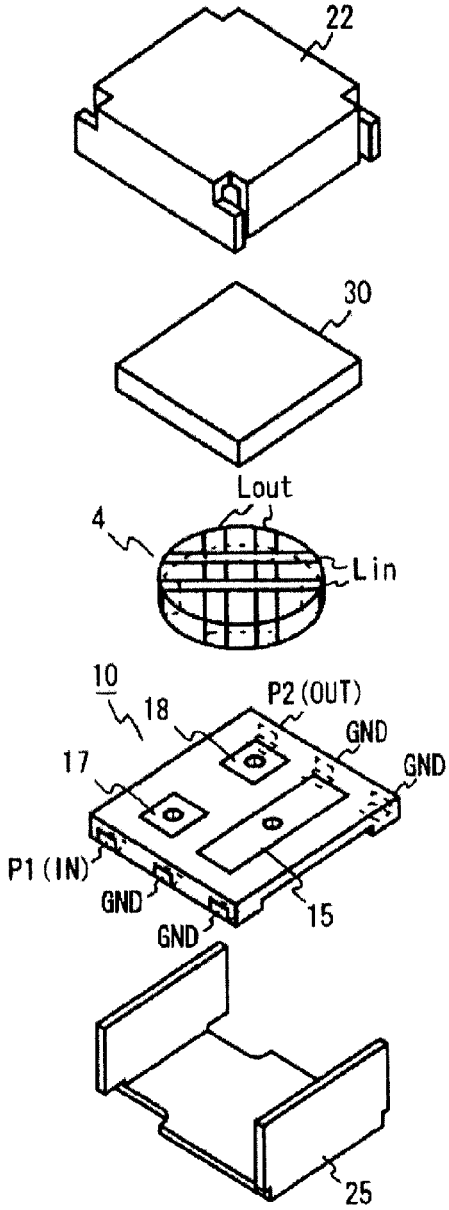
Fig. 13 Related Art
FIG. 13 is an exploded perspective view showing a conventional non-reciprocal circuit device.
Figure 14:
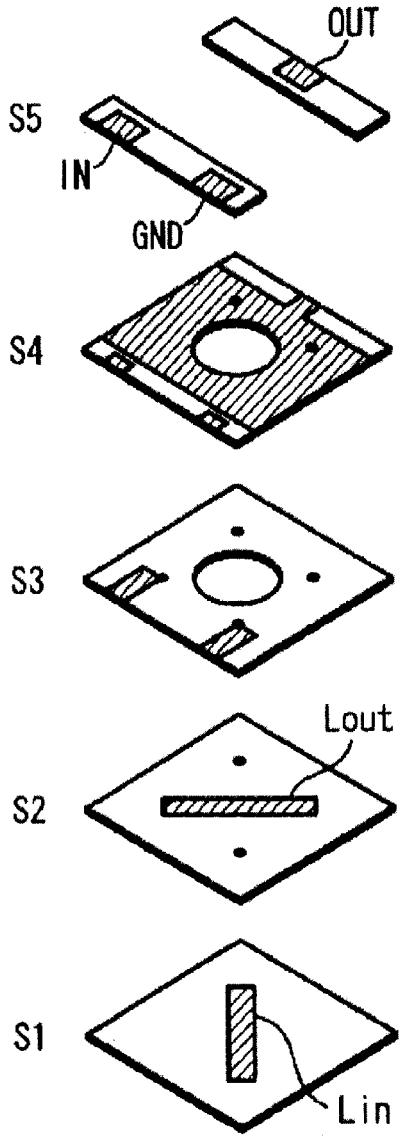
Fig. 14 Related Art
FIG. 14 is an exploded perspective view showing a conventional central conductor assembly.

With respect to the non-reciprocal circuit devices of Example 1 and Comparative Examples 1 and 2, the measurement results of insertion loss and isolation are shown in FIGS. 11(*a*) and 11(*b*). The non-reciprocal circuit device of Example 1 had excellent insertion loss of 0.4 dB, while the non-reciprocal circuit device of Comparative Example 1 had insertion loss of about 0.8 dB, and the non-reciprocal circuit device of Comparative Example 2 had insertion loss larger than that of Comparative Example 1 by about 0.1 dB. With respect to isolation, the non-reciprocal circuit devices of Example 1 and Comparative Examples 1 and 2 were substantially equal. This indicates that the arrangement of the first and second central conductors in the central conductor assembly had large influence on insertion loss characteristics, and that when the first central conductor has first and second lines formed on the first main surface of the laminate and third lines formed in the laminate, and when the second central conductor is formed on the first main surface such that it crosses the third lines between the first and second lines via a magnetic layer, a non-reciprocal circuit device having excellent insertion loss and isolation characteristics can be obtained.

EFFECT OF THE INVENTION

The formation of part of first and second central conductors on a first main surface of the laminate provides an inductance element with a larger quality coefficient (Q) than their formation in the laminate. Further, the reduction of resistance of a first central conductor constituting a first inductance element provides improved insertion loss characteristics. The non-reciprocal circuit device of the present invention comprising a central conductor assembly having the above structure has excellent insertion loss characteristics and wide bandwidth despite the small size, suitable for cell phones.

What is claimed is:

1. A central conductor assembly for use in a non-reciprocal circuit device comprising a first inductance element and a first capacitance element constituting a first parallel resonance circuit between a first input/output port and a second input/output port, and a second inductance element and a second capacitance element constituting a second parallel resonance circuit between the second input/output port and the ground, said central conductor assembly comprising said first and second inductance elements;

at least a first central conductor constituting said first inductance element being formed by series-connecting ends of first lines and second lines formed on a first main surface of a first magnetic layer of a laminate, comprising pluralities of magnetic layers, to third lines formed on a second magnetic layer disposed below the first magnetic layer in said laminate through via-holes;

a second central conductor constituting said second inductance element being formed on the first main surface of the first magnetic layer of said laminate, such that the second central conductor extends between said first and second lines and crosses said third lines via said first magnetic layer; and first terminal electrodes connected to the other ends of the first lines of said first central conductors through via-holes formed in the laminate, third terminal electrodes connected to the other ends of the second lines of said first central conductors through via-holes formed in the laminate, and second terminal electrodes connected to both ends of said second central conductor through via-holes formed in the laminate being formed on a second main surface of said laminate, wherein a set of the first lines is disposed separately from a set of the second lines, and the first lines and the second lines are similarly oriented.

2. The central conductor assembly according to claim 1, wherein said first inductance element is formed by connecting pluralities of said first central conductors in parallel.

3. The central conductor assembly according to claim 1, wherein pluralities of said first to third lines are arranged in parallel, and said second central conductor is perpendicular to said third lines via a magnetic layer.

4. The central conductor assembly according to claim 1, wherein the first lines are arranged in parallel on one side of the second central conductor;

the second lines are arranged in parallel on another side of the second central conductor; and the third lines are arranged in parallel to one another and the first and second lines.

5. A non-reciprocal circuit device comprising a first inductance element and a first capacitance element constituting a first parallel resonance circuit between a first input/output port and a second input/output port, and a second inductance element and a second capacitance element constituting a second parallel resonance circuit between the second input/output port and the ground, said non-reciprocal circuit device comprising:

at least a first central conductor constituting said first inductance element being formed by series-connecting ends of first lines and second lines formed on a first main surface of a first magnetic layer of a laminate, comprising pluralities of magnetic layers, to the third lines formed on a second magnetic layer disposed below the first magnetic layer in said laminate through via-holes, a second central conductor constituting said second inductance element being formed on the first main surface of the first magnetic layer of said laminate such that the second central conductor extends between said first and second lines and crosses said third lines via said first magnetic layer, and first terminal electrodes connected to the other ends of the first lines of said first central conductors through via-holes formed in the laminate, third terminal electrodes connected to the other ends of the second lines of said first central conductors through via-holes formed in the laminate, and second terminal electrodes connected to both ends of said second central conductor through via-holes formed in the laminate being formed on a second main surface of said laminate;

a permanent magnet for applying a DC magnetic field to said central conductor assembly; and a multilayer substrate containing said first and second capacitance elements;

said central conductor assembly being mounted on a main surface of said multilayer substrate, wherein a set of the first lines is disposed separately from a set of the second lines, and the first lines and the second lines are similarly oriented.

6. A central conductor assembly for use in a non-reciprocal circuit device comprising first and second input/output ports, a first inductance element and a first capacitance element constituting a first parallel resonance circuit between the first input/output port and the second input/output port, and a second inductance element and a second capacitance element constituting a second parallel resonance circuit between the second input/output port and the ground, said central conductor assembly comprising a laminate comprising pluralities of magnetic layers and having first and second main surfaces, pluralities of first central conductors constituting said first inductance element, and a second central conductor constituting said second inductance element, said first main surface corresponding to a surface of a first magnetic layer, and said second main surface corresponding to a rear surface of a lowermost magnetic layer;

said first central conductors being integrally formed by series-connecting ends of first lines and second lines formed on the first main surface of said laminate to third lines formed on a second magnetic layer disposed below said first magnetic layer in said laminate through via-holes;

said second central conductor being integrally formed on the first main surface of said laminate, such that the second central conductor extends between said first and second lines and crosses said third lines via said first magnetic layer; and first terminal electrodes connected to the other ends of the first lines of said first central conductors through via-holes formed in the laminate, third terminal electrodes connected to the other ends of the second lines of said first central conductors through via-holes formed in the laminate, and second terminal electrodes connected to both ends of said second central conductor through via-holes formed in the laminate being formed on the second main surface of said laminate, wherein a set of the first lines is disposed separately from a set of the second lines, and the first lines and the second lines are similarly oriented.

* * * * *